US010092126B2

(12) United States Patent
Baines

(10) Patent No.: US 10,092,126 B2
(45) Date of Patent: Oct. 9, 2018

(54) WINDOW CURTAIN RODS WITH ALIGNMENT BRACKETS

(71) Applicant: Maytex Mills, Inc., New York, NY (US)

(72) Inventor: David M. Baines, Bedford, NY (US)

(73) Assignee: Maytex Mills, Inc., New York, NY (US)

( * ) Notice: Subject to any disclaimer, the term of this patent is extended or adjusted under 35 U.S.C. 154(b) by 0 days.

(21) Appl. No.: 15/266,841

(22) Filed: Sep. 15, 2016

(65) Prior Publication Data

US 2017/0079457 A1 Mar. 23, 2017

Related U.S. Application Data

(60) Provisional application No. 62/220,021, filed on Sep. 17, 2015.

(51) Int. Cl.

| | |
|---|---|
| ***A47H 1/00*** | (2006.01) |
| ***A47H 1/08*** | (2006.01) |
| ***A47K 10/04*** | (2006.01) |
| ***A47H 1/022*** | (2006.01) |
| ***A47H 1/122*** | (2006.01) |
| ***A47H 1/142*** | (2006.01) |

(Continued)

(52) U.S. Cl.

CPC ..... *A47H 1/022* (2013.01); *A47H 1/102* (2013.01); *A47H 1/12* (2013.01); *A47H 1/122* (2013.01); *A47H 1/13* (2013.01); *A47H 1/14* (2013.01); *A47H 1/142* (2013.01); *A47H 2001/0215* (2013.01)

(58) Field of Classification Search

CPC ..... A47H 1/022; A47H 1/122; A47H 1/142; A47H 2001/0215; A47H 1/08; A47H 1/02; A47H 1/10; A47H 1/102; A47H 1/104; A47H 1/12; A47H 1/124; A47H 1/13; A47H 1/14; A47H 1/144; A47H 2001/003; A47H 1/00; A47K 3/38

USPC ..... 211/105.1–105.6, 123; 248/251, 257, 248/227.4, 254, 258, 259, 262, 261, 265, 248/267, 269

See application file for complete search history.

(56) References Cited

U.S. PATENT DOCUMENTS 562,380 A * 6/1896 Durphy ..... A47H 1/122 160/327

852,941 A * 5/1907 Fenian ..... A47H 1/122 248/265

(Continued)

*Primary Examiner* — Jennifer E. Novosad

(74) *Attorney, Agent, or Firm* — Alan G. Towner; Leech Tishman Fuscaldo & Lampl

(57) ABSTRACT

Window curtain rod assemblies that include a telescoping rod and two alignment bracket assemblies, each including a support arm and an alignment mounting bracket are disclosed. Each alignment bracket assembly includes a horizontal portion that extends in a horizontal direction parallel with an axial direction of the telescoping curtain rod away from the vertical edges of a window frame to allow the alignment bracket assembly to be mounted adjacent to the vertical edges of the window frame, while still allowing the curtain to extend beyond the vertical edge of the window frame. The support arms may include a first substantially cylindrical end and a second end. The alignment mounting bracket may be attached to the second end, and include a vertical guide leg having a vertical guide edge and horizontal guide edge.

22 Claims, 8 Drawing Sheets

(51) Int. Cl.

| | |
|---|---|
| ***A47H 1/13*** | (2006.01) |
| ***A47H 1/14*** | (2006.01) |
| ***A47H 1/12*** | (2006.01) |
| ***A47H 1/102*** | (2006.01) |
| *A47H 1/02* | (2006.01) |

(56) References Cited

U.S. PATENT DOCUMENTS

| | | | | | |
|---|---|---|---|---|---|
| 978,114 | A | | 12/1910 | Cook | |
| 1,341,562 | A | * | 5/1920 | Kasbohm | A47H 1/122 248/259 |
| 1,537,242 | A | * | 5/1925 | Lukins | F24D 19/00 126/332 |
| 2,433,527 | A | * | 12/1947 | Mohr | A47H 1/122 160/19 |
| 2,459,619 | A | * | 1/1949 | Chatterton | A47H 1/122 248/253 |
| 2,551,432 | A | * | 5/1951 | Goodman | A47H 1/122 248/264 |
| 2,560,942 | A | * | 7/1951 | Ford | A47H 1/022 211/105.3 |
| 2,653,718 | A | * | 9/1953 | Woodward | A47H 1/122 211/105.2 |
| 2,689,103 | A | * | 9/1954 | Ackerman | A47H 1/122 248/257 |
| 2,739,644 | A | * | 3/1956 | Brand | A47H 1/122 160/39 |
| 2,937,838 | A | * | 5/1960 | Kelvington | A47H 1/122 248/265 |
| 2,998,955 | A | * | 9/1961 | Hertzog | A47H 1/122 248/263 |
| 3,095,033 | A | * | 6/1963 | Polkosnik | A47H 1/122 160/126 |
| 3,104,086 | A | * | 9/1963 | Salzmann | A47H 1/122 160/345 |
| 3,504,805 | A | * | 4/1970 | Doyle | A47H 1/022 138/109 |
| 4,140,294 | A | * | 2/1979 | Zwarts | A47H 1/122 248/265 |
| 4,322,050 | A | * | 3/1982 | Roach | A47H 1/122 248/222.51 |
| 4,915,343 | A | * | 4/1990 | Terlecke | A47H 1/14 248/222.41 |
| 5,082,226 | A | | 1/1992 | Mahan | |
| 5,549,407 | A | | 8/1996 | Levi et al. | |
| 5,678,703 | A | * | 10/1997 | Sawyer | A47H 1/02 211/105.1 |
| 5,702,010 | A | * | 12/1997 | Liang | A47G 25/0685 211/105.1 |
| 6,233,877 | B1 | * | 5/2001 | Monroe | A62B 1/04 182/230 |
| 7,322,552 | B1 | * | 1/2008 | Lin | A47H 1/122 160/89 |
| 7,641,060 | B2 | * | 1/2010 | Bishop | A47H 1/02 211/105.1 |
| 8,469,207 | B2 | | 6/2013 | Rowan et al. | |
| 8,479,931 | B1 | * | 7/2013 | Richards | A47H 1/022 211/105.2 |
| 8,814,114 | B2 | | 8/2014 | Baines | |
| 8,851,305 | B2 | | 10/2014 | Didehvar | |
| 8,960,456 | B2 | | 2/2015 | Didehvar | |
| 2003/0052244 | A1 | * | 3/2003 | Goldstein | A47H 1/08 248/263 |
| 2005/0199567 | A1 | * | 9/2005 | Tardiff | B66C 1/10 211/105.3 |
| 2007/0090246 | A1 | | 4/2007 | Carvalho et al. | |
| 2009/0173457 | A1 | * | 7/2009 | Navarro | A47H 1/122 160/330 |
| 2012/0005823 | A1 | | 1/2012 | Baines | |
| 2013/0112639 | A1 | | 5/2013 | Baines | |
| 2013/0341474 | A1 | | 12/2013 | Baines | |
| 2014/0166603 | A1 | | 6/2014 | Baines | |
| 2016/0242586 | A1 | * | 8/2016 | Mateer | A47H 1/102 |
| 2017/0079457 | A1 | * | 3/2017 | Baines | A47H 1/022 |

* cited by examiner

WINDOW CURTAIN RODS WITH ALIGNMENT BRACKETS

CROSS-REFERENCE TO RELATED APPLICATION

This application claims the benefit of U.S. Provisional Patent Application Ser. No. 62/220,021, filed on Sep. 17, 2015, which is incorporated herein by reference.

FIELD OF THE INVENTION

This invention relates to window curtain rods, and more particularly relates to window curtain rod assemblies that are capable of being installed without the need to measure for bracket placement.

BACKGROUND INFORMATION

The installation of window curtain rods can be cumbersome, requiring painstaking measuring. In order for window curtains to extend beyond the outer vertical edges of windows for light blocking and aesthetics, conventional window curtain rod brackets must be positioned at least an inch or more beyond the vertical edges of the window. This requires measuring outwards and then upwards for final bracket placement. In this process, mistakes in measuring are common, frequently resulting in misplaced holes in the wall and wall damage. Furthermore, when the final bracket placement of conventional window curtain rod brackets is at least an inch or more beyond the vertical edges of the window, the bracket is often mounted only onto drywall. When window curtain rod brackets are mounted only onto drywall they often come out of the wall when used with curtains other than light-weight curtains, draperies or sheers.

Accordingly, a need exists for a window curtain rod assembly that extends beyond the outer vertical edges of window that can installed without the need to measure and without bring mounted only onto drywall.

SUMMARY OF THE INVENTION

Window curtain rod assemblies are provided that include a telescoping rod and two alignment bracket assemblies, each including a support arm and an alignment mounting bracket. Each alignment bracket assembly includes a horizontal portion that extends in a horizontal direction parallel with an axial direction of the telescoping curtain rod away from the vertical edges of a window frame to allow the alignment bracket assembly to be mounted adjacent to the vertical edges of the window frame, while still allowing the curtain to extend beyond the vertical edge of the window frame. The support arms may include a first substantially cylindrical end and a second end. The alignment mounting bracket may be attached to the second end, and include a vertical guide leg having a vertical guide edge and horizontal guide edge.

An aspect of the present invention is to provide a window curtain rod assembly comprising: a telescoping curtain rod comprising a first end rod section and a second end rod section axially moveable with respect to each other along an axis of the telescoping curtain rod; a first alignment bracket assembly; and a second alignment bracket assembly. The first alignment bracket assembly comprises a first support arm including a first substantially cylindrical end receiving an end of the first end rod section and having an axis substantially aligned with the axis of telescoping curtain rod, and a second end laterally offset from the first substantially cylindrical end in a direction substantially perpendicular to the axis of the telescoping curtain rod; and a first alignment mounting bracket attached to the second end of the first support arm including a vertical guide leg laterally offset from the axis of the telescoping curtain rod by a first curtain overhang distance measured in a direction perpendicular to the axis of the telescoping curtain rod, the vertical guide leg comprising a vertical guide edge laterally offset from the end of the first end rod section by a first curtain extension distance measured in a direction parallel with the axis of the telescoping curtain rod. The second alignment bracket assembly comprises a second support arm including a first substantially cylindrical end receiving an end of the second end rod section and having an axis substantially aligned with the axis of the telescoping curtain rod, and a second end laterally offset from the first substantially cylindrical end in a direction substantially perpendicular to the axis of the telescoping curtain rod; and a second alignment mounting bracket attached to the second end of the second support arm including a vertical guide leg laterally offset from the axis of the telescoping curtain rod by a second curtain overhang distance measured in a direction perpendicular to the axis of the telescoping curtain rod, the vertical guide leg comprising a vertical guide edge laterally offset from the end of the first end rod section by a second curtain extension distance measured in a direction parallel with the axis of the telescoping curtain rod.

Another aspect of the present invention is to provide an alignment bracket assembly for a window curtain rod comprising: a support arm including a first substantially cylindrical end defining an axial direction structured and arranged to receive an end of a curtain rod, and a second end laterally offset from the first substantially cylindrical end in a direction substantially perpendicular to the axial direction of first substantially cylindrical end; and an alignment mounting bracket attached to the second end of the first support arm including a vertical guide leg laterally offset from the axial direction of first substantially cylindrical end by a curtain overhang distance measured in a direction perpendicular to the axial direction of first substantially cylindrical end, the vertical guide leg comprising a vertical guide edge laterally offset from the first substantially cylindrical end by a curtain extension distance measured in a direction parallel with the axial direction of first substantially cylindrical end.

A further aspect of the present invention is to provide a method of mounting a window curtain rod assembly as described above adjacent to a window. The method comprises positioning the vertical guide edge of first alignment bracket assembly along a first vertical portion of a window frame; positioning the vertical guide edge of the second alignment bracket assembly along a second vertical portion of the window frame; axially locking the first end rod section with respect to the second end rod section; and fastening the first and second alignment bracket assemblies at their respective positions with respect to the window frame.

These and other aspects of the present invention will be more apparent from the following description.

DETAILED DESCRIPTION

The present invention provides window curtain rods with alignment brackets that are easy to install. The alignment brackets are attached to a wall against the vertical edge of a window frame while also allowing the curtain to extend horizontally beyond the vertical edges of the window frame. In certain embodiments, the alignment bracket assemblies may be mounted on a window stud adjacent to the window frame. In accordance with typical window construction techniques, window studs are positioned adjacent to the vertical portions of a window frame, while areas away from the window frame may not have studs at such locations, e.g., such locations may only comprise drywall or plaster with no underlying studs. Mounting the alignment bracket assemblies of the present invention on window studs provides the window curtain rod assembly additional stability to accommodate a variety of window curtains. The rod and curtain are allowed to extend beyond the vertical edges of the window due to a portion of the alignment bracket assembly that extends in a horizontal curtain extension distance parallel with an axial direction of the telescoping curtain rod. If the user chooses to position the rod at a higher level, this can be done by aligning the bracket at the desired height along the vertical window edge. The installation process for these window curtain rod assemblies may take only a few minutes.

Figure 1:
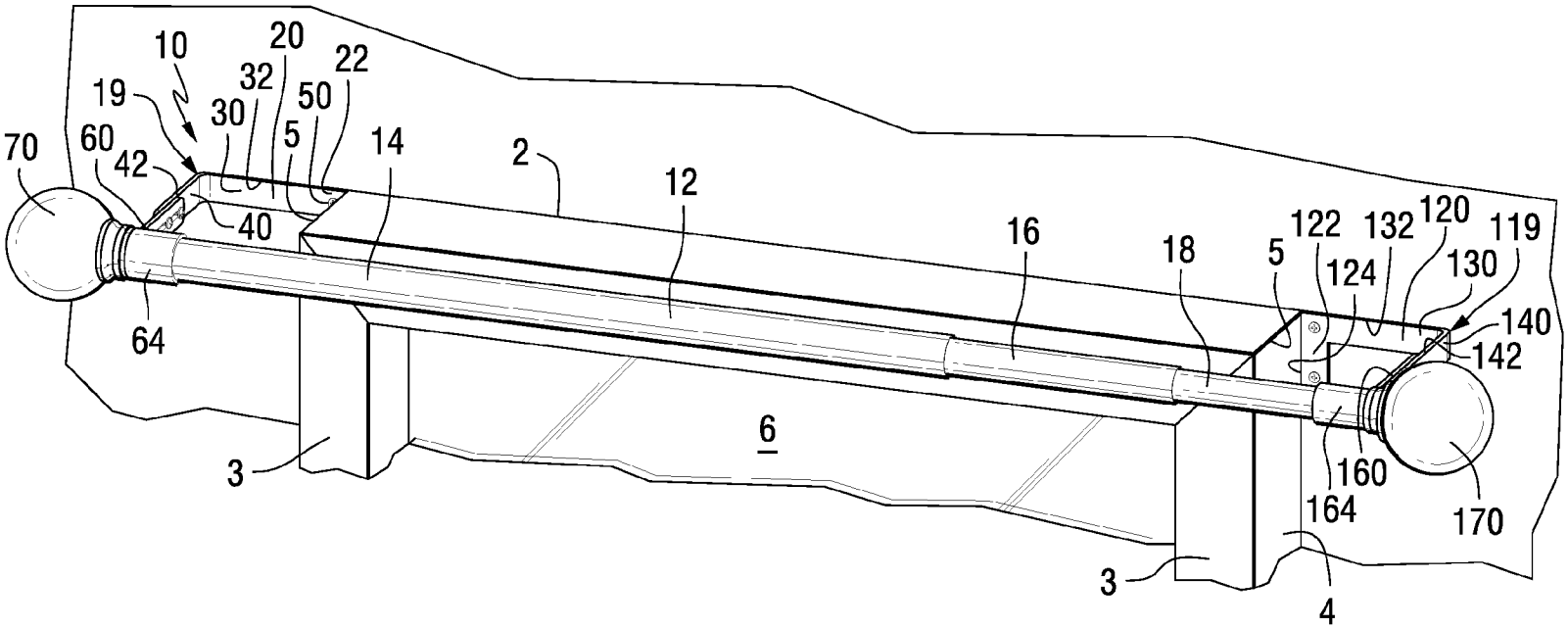
FIG. 1 is an isometric view of a window curtain rod assembly in accordance with an embodiment of the present invention, illustrating the window curtain rod assembly mounted around a window frame in accordance with an embodiment of the present invention.
Figure 2:
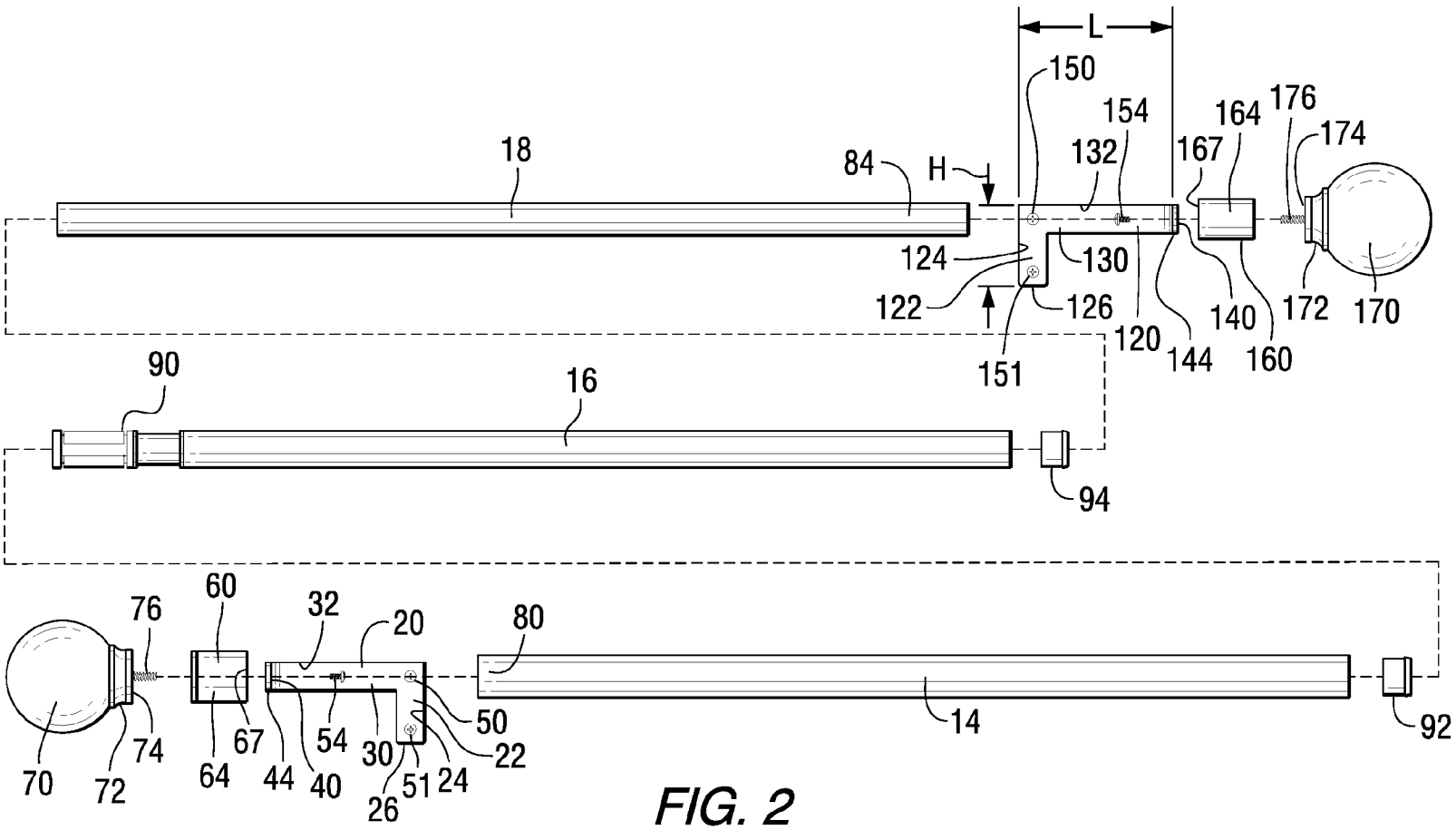
FIG. 2 is a front exploded view of the window curtain rod assembly of FIG. 1
Figure 3:
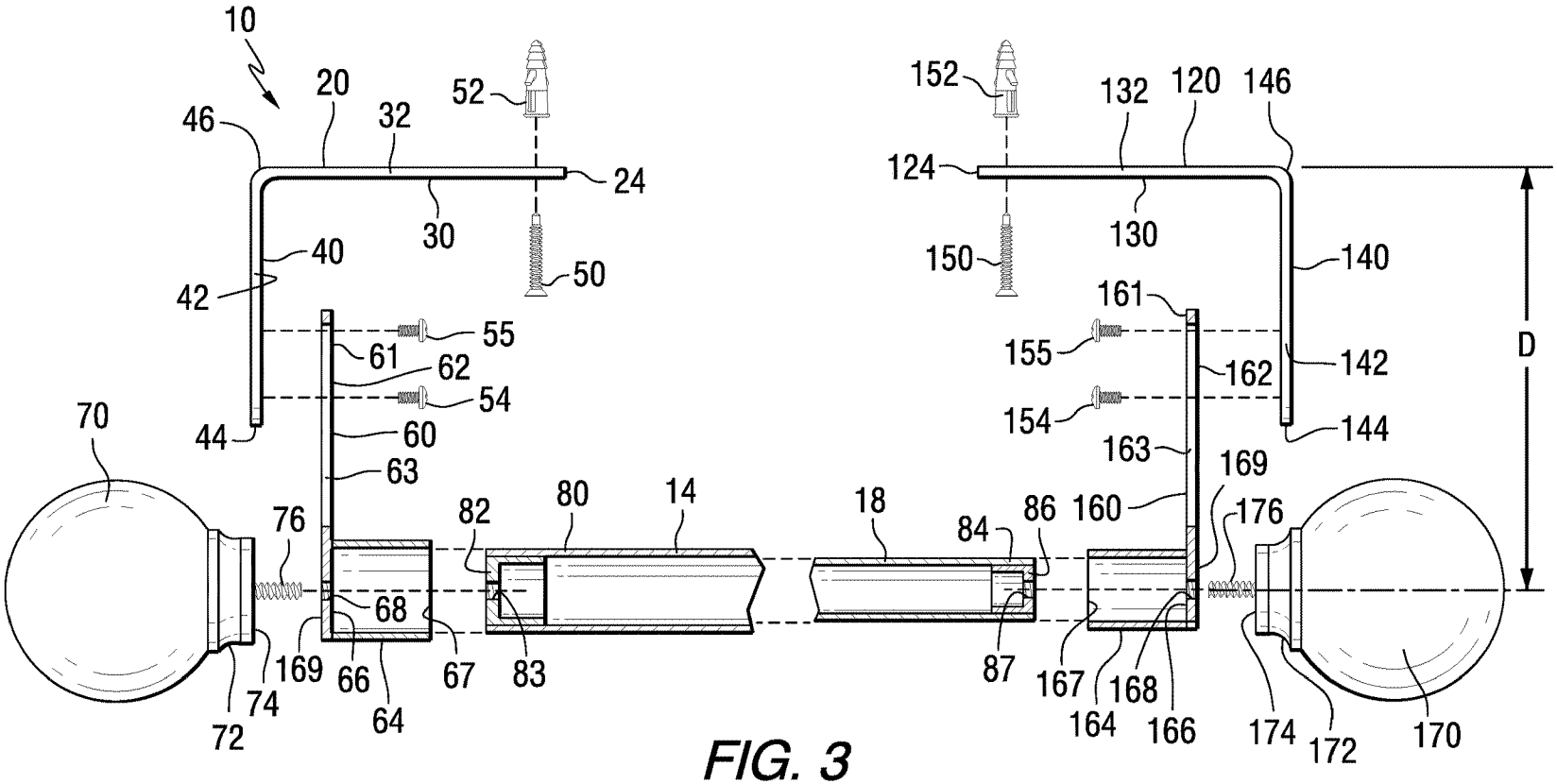
FIG. 3 is a top exploded view of the bracket assemblies of the window curtain rod assembly of FIG. 1.

FIG. 1 illustrates a window curtain rod assembly 10 mounted over a window frame 2 in accordance with an embodiment of the present invention. The window frame 2 includes a front wall 3, exterior window frame sidewalls 4 and top edge 5. As used herein, the terms "window frame", "front wall", "exterior window frame sidewalls" and "top edge" may refer to casement windows including additional material surrounding the opening in the wall, or windows only including an opening in the wall. As used herein, "exterior window frame sidewall" means a vertical portion of a window frame. The window curtain rod assembly 10 includes a telescoping curtain rod 12, a first alignment bracket assembly 19 and a second alignment bracket assembly 119. As shown in FIGS. 1-3, the telescoping curtain rod 12 comprises a first telescoping rod section 14 (also called a first end rod section), a second telescoping rod section 16 (also called an intermediate section) and a third telescoping rod section 18 (also called a second end rod section). The first, second and third rod sections are configured in a telescoping arrangement such that a portion of the third rod section 18 is configured to slide into a portion of the second rod section 16, and a portion of the second rod section 16 is configured to slide into a portion of the first rod section 14. The telescoping curtain rod 12 defines an axial direction. In the embodiment shown, the telescoping curtain rod 12 includes first, second and third rod sections. However, any other suitable number of rod sections may be used, e.g., one, two, four or more rod sections. For example, a first end rod section and a second end rod section may be axially moveable and/or lockable with respect to each other.

Figure 4:
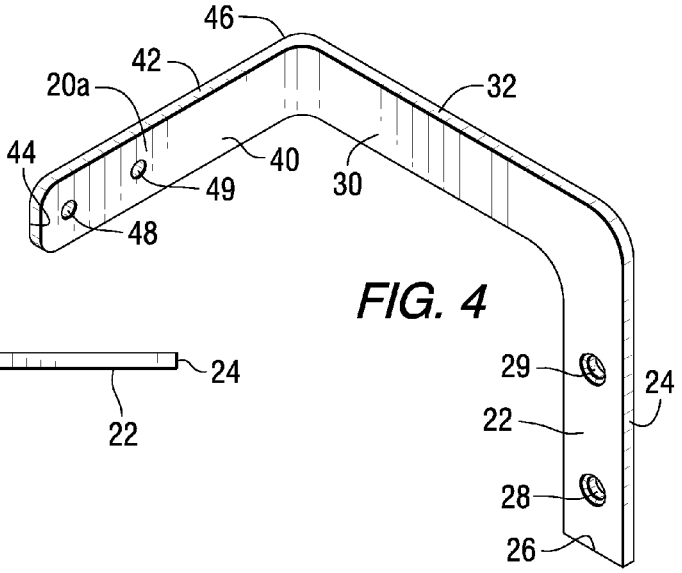
FIG. 4 is an isometric view of an alignment mounting bracket in accordance with an embodiment of the present invention.
Figure 7:
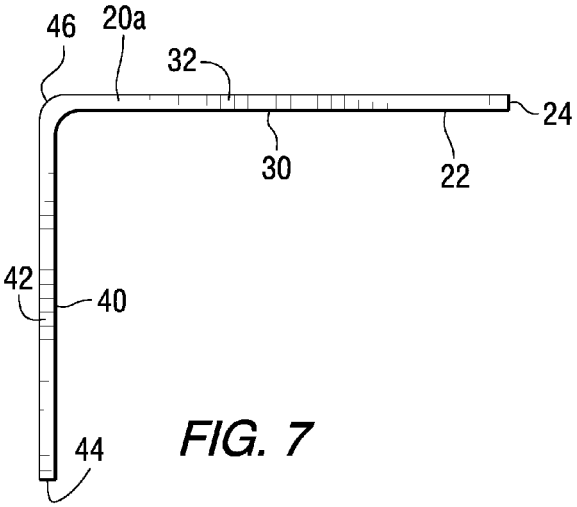
FIG. 7 is a top view of the alignment mounting bracket of FIG. 4.
Figure 5:
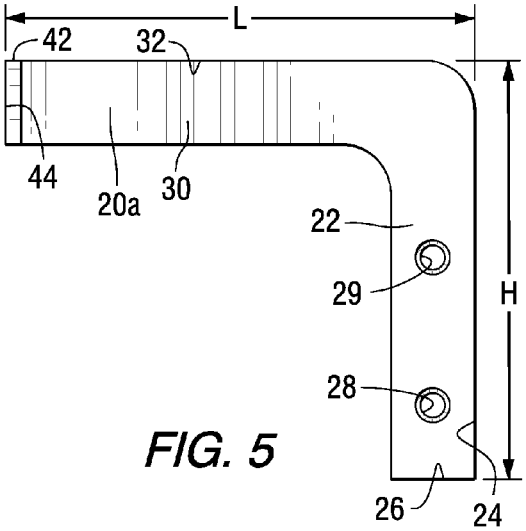
FIG. 5 is a front view of the alignment mounting bracket of FIG. 4.
Figure 6:
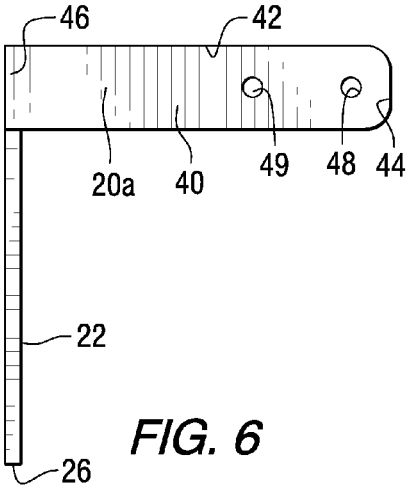
FIG. 6 is a side view of the alignment mounting bracket of FIG. 4.
Figure 8:
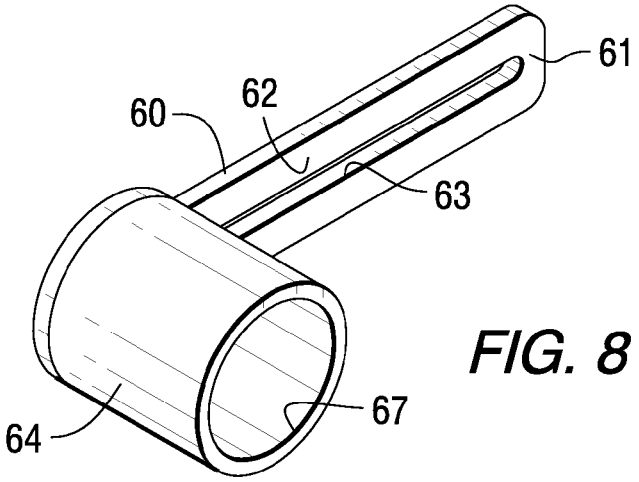
FIG. 8 is an isometric view of a support arm in accordance with an embodiment of the present invention.
Figure 11:
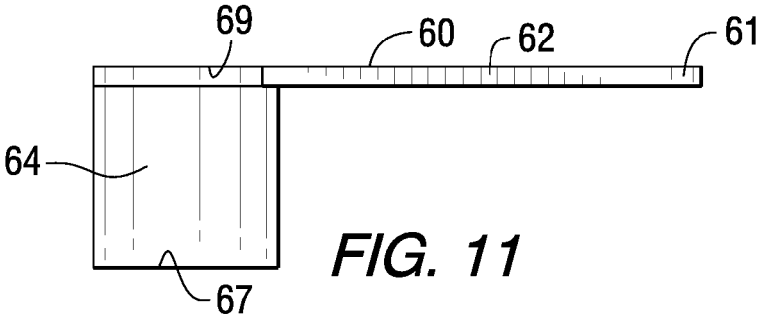
FIG. 11 is a top view of the support arm of FIG. 8.
Figure 9:
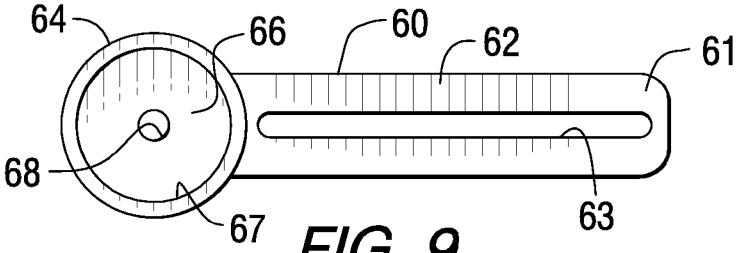
FIG. 9 is a front view of the support arm of FIG. 8.

As shown in FIGS. 1-3, the first alignment bracket assembly 19 includes an alignment mounting bracket 20 and a support arm 60. The alignment mounting bracket 20 includes a vertical guide leg 22, a first horizontal leg 30 and a second horizontal leg 40. The vertical guide leg 22 includes a vertical guide edge 24, a lower end 26 and an upper end terminating at a horizontal guide edge 32. As used herein, the term "vertical guide edge" means a substantially straight edge in a substantially vertical direction that is used to align the edge with a vertical portion of a window frame. As shown in FIG. 4, the vertical guide leg 22 may also include alignment mounting bracket wall mounting holes 28 and 29. The first horizontal leg 30 may extend from the vertical guide leg 22 in a direction substantially parallel with the axial direction of the telescoping curtain rod 12, and includes a horizontal guide edge 32 and a window frame end terminating in the vertical guide edge 24. The first horizontal leg 30 provides the ability for the curtain to extend horizontally beyond the window frame while mounting the alignment mounting bracket adjacent to the vertical portion of a window frame, which may correspond to the position of an underlying window stud. The second horizontal leg 40 extends from the first horizontal leg in a direction substantially perpendicular to the axial direction of the telescoping curtain rod 12, and includes an upper edge 42 and an end 44. The second horizontal leg 40 may also include support arm mounting holes 48 and 49. The first and second horizontal legs 30 and 40 may intersect to form an alignment intersection 46. In accordance with certain embodiments of the present invention, the horizontal guide edge 32 of the first horizontal leg 30 may be substantially aligned with the upper edge 42 of the second horizontal leg 40.

As shown in FIGS. 2 and 3, the bracket assembly 19 has a vertical length H, a curtain extension distance L and a curtain overhang distance D selected to properly position the window curtain rod assembly 10 during installation around a window frame 2. The curtain extension distance L may be selected to allow the telescoping rod 12 and curtain to extend away from the exterior window frame sidewall 4 of the window frame 2 in a direction parallel with the axial direction of the telescoping curtain rod 12. The curtain extension distance L offsets the vertical guide edge 24 from the end 80 of the first rod section 14 and/or the rod abutment face 66 of the support arm 60 in a direction parallel with the axis of the telescoping curtain rod 12. For example, the curtain extension distance L of the bracket assembly 19 may typically range from 1 to 8 inches, or from 2 to 6 inches, or from 3 to 5 inches. The vertical length H of the alignment mounting bracket 20 may also be selected to properly position the window curtain rod assembly 10 during installation around a window frame 2. The vertical length H may be selected to provide the vertical guide edge 24 and to provide access to the alignment mounting bracket wall mounting holes 28 and 29. For example, the vertical length H may range from 0.5 to 4 inches, or from 1 to 3 inches, or from 1.5 to 2.5 inches. The curtain overhang distance D of the bracket assembly 19 may also be selected to properly position the telescoping rod 12 away from the wall. The curtain overhang distance D offsets the vertical guide leg 22 from the axis of the telescoping curtain rod 12 in a direction perpendicular to the axis of the telescoping curtain rod. For example, the curtain overhang distance D may typically range from 0.5 to 8 inches, or from 1 to 6 inches, or from 1.5 to 4.5 inches.

As shown in FIG. 1, the vertical guide edge 24 of the alignment mounting bracket 20 may be positioned to align with the exterior window frame sidewall 4 of the window frame 2. In accordance with an embodiment of the present invention, the vertical guide edge 24 may be positioned directly adjacent to the exterior window frame sidewall 4 of a window frame 2. When the vertical guide edge 24 is positioned to align with the exterior window frame sidewall 4 of a window frame 2, this arrangement may provide for the alignment mounting bracket to be mounted on an underlying window stud. In another embodiment, the vertical guide edge may be positioned directly above the exterior window frame sidewall 4 of a window frame 2. As shown in FIG. 1, the horizontal guide edge 32 of the mounting alignment bracket 20 may be positioned to align with the top edge 5 of the window frame 2. In another embodiment, a user may desire to position the window curtain rod assembly higher than the top edge 5 of the window frame. Such positioning may be performed by aligning the vertical guide edge 24 with the exterior window frame sidewall 4 of a window frame 2. The use of the vertical guide edge 24 and/or the horizontal guide edge 32 in accordance with an embodiment of the present invention provides for installation of the window curtain rod assembly 10 without the need to measure.

When the alignment mounting bracket 20 is positioned adjacent to the exterior window frame sidewall 4 or vertical portion of a window frame 2, the curtain extension distance L of the alignment mounting bracket 20 provides for the telescoping curtain rod 12 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 10 provides the light-blocking and aesthetic function, and provides the ability for the alignment bracket assembly 19 to be mounted on the window stud without measuring.

FIGS. 4-7 illustrate an alignment mounting bracket 20*a* in accordance with another embodiment of the present invention. Similar element numbers are used in FIGS. 4-7 for common features that are present in the embodiment of FIGS. 1-3. As shown in FIGS. 4-7, the alignment mounting 20*a* of the vertical guide leg may have a vertical length H slightly longer than the embodiment shown in FIGS. 1-3. For example, vertical length H may typically range from 0.5 to 8 inches, or from 1 to 6 inches, or from 1.5 to 5 inches, or from 2 to 4 inches.

As shown in FIGS. 1-7, the alignment mounting bracket wall mounting holes 28 and 29 may be located at different locations depending on the vertical length H of the alignment mounting bracket 20 and 20*a*. In the embodiment shown in FIGS. 1-3, the upper alignment mounting bracket wall mounting hole 29 may be positioned near the horizontal guide edge 32, and the lower alignment mounting bracket wall mounting hole 28 may be positioned near the lower end 26 of the vertical guide leg 22. In the embodiment shown in FIGS. 4-7, the upper alignment mounting bracket wall mounting hole 29 may be positioned near a midpoint of the lower end 26 of the vertical guide leg 22 and the horizontal guide edge 32, and the lower alignment mounting bracket wall mounting hole 28 may be positioned near the lower end 26 of the vertical guide leg 22. In accordance with embodiments of the present invention, any other suitable arrangement of bracket wall mounting holes 28 and 29 may be used.

Figure 10:
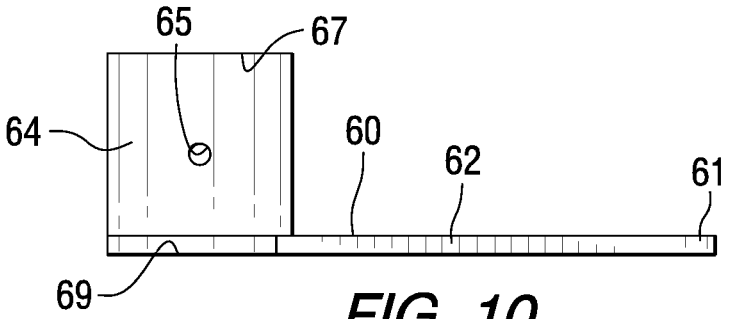
FIG. 10 is a bottom view of the support arm of FIG. 8.

The support arm 60 includes a first substantially cylindrical end 64 and a second end 61. The first substantially cylindrical end 64 defines an axis substantially aligned with the axis of the telescoping curtain rod 12. The second end 61 may be laterally offset from the first substantially cylindrical end 64 in a direction perpendicular to the axis of the telescoping rod and/or the axis of the first substantially cylindrical end 64. The first substantially cylindrical end 64 may include a rod abutment face 66, a rod receiving opening 67, and a finial abutment face 69. The rod receiving opening 67 has a cylindrical surface with an inner diameter selected based upon the outer diameter of the end 80 of the first rod section 14 that it receives. The rod abutment face 66 may include a threaded finial hole 68. However, in accordance with embodiments of the present invention, the finial hole 68 of the first support arm 60 may be non-threaded. In accordance with an embodiment of the present invention, a mounting section 62 may be provided between the first substantially cylindrical end 64 and the second end 61. As shown in FIG. 10, the first substantially cylindrical end 64 may include an optional threaded thumb screw hole 65. The thumb screw hole 65 may be configured to receive a mechanical fastener to contact the first rod section. The mechanical fastener may be a thumb screw, threaded bolt, threaded screw, or any other conventional type of mechanical fastener.

In accordance with an embodiment of the present invention, the mounting section 62 of the support arm 60 includes a connection slot 63 configured to allow the alignment mounting bracket 20 to be slideably mounted on the second end 61 of the support. The alignment mounting bracket 20 being slideably mounted to the support arm 60 allows the curtain overhang distance D to be easily adjusted after installation. However, any other type of suitable mounting of the alignment bracket 20 to the support arm may be used, e.g., connection holes, welding, or the like. Alternatively, the alignment mounting bracket 20 and the support arm 60 may be may be fixed in relation to each other or integrally formed.

As shown in FIGS. 1-3, a finial 70 may also be attached to the alignment bracket assembly 19. The finial 70 includes a collar 72, a bracket engaging face 74 and a threaded bolt 76. In accordance with certain embodiments of the present invention, when the finial 70 is attached to the support arm 60, the threaded bolt 76 is substantially aligned with the axis of the first substantially cylindrical end 64 and the axis of the telescoping rod 12. The threaded bolt 76 may be threadingly engaged with the threaded finial hole 68 in the abutment face 69 of the first support arm 60. In accordance with another embodiment of the present invention, the threaded bolt 76 may only pass through the finial hole 68. As shown in FIG. 3, the end 80 of the first rod section 14 may include an internal sleeve 82 with a threaded hole 83. The threaded bolt 76 may be configured to be threadingly engaged with the threaded hole 83 of the sleeve 82. However, any other suitable shape and arrangement of engagement between the finial 70 and the end 80 of first rod section 14 may be used, e.g., pins, mechanical fasteners, clamps, snap-fit, adhesives, or the like. In accordance with another embodiment of the present invention, the finial 70 may not directly engage the end 80 of the first rod section 14, e.g., the end 80 of the first rod section 14 may only be engaged by the first substantially cylindrical end 64. For example, the end 80 of first rod section 14 may be engaged by the first substantially cylindrical end 64 using frictional engagement, pins, mechanical fasteners, clamps, snap-fit, adhesives, or the like.

In accordance with an embodiment of the present invention, engagement of the threaded bolt 76 with the threaded finial hole 68 and the threaded hole 83 of the sleeve 82 of the end 80 of the first rod section 14 provides secure attachment. For example, the end 80 of the first rod section 14 engages the rod abutment face 64, the sleeve 82 may have a threading engagement with the threaded bolt 76, a mechanical fastener may contact the end 80 of the first rod section 14 through the thumb screw hole 65, and the bracket engaging face 74 engages the finial abutment face 69 of the first substantially cylindrical end 64 of the support arm 60. This arrangement results in the first rod section 14 being rigidly secured in the support arm 60.

As shown FIGS. 1-7, the alignment mounting bracket 20 may be secured to the wall with mechanical fasteners 50 and 51 through alignment mounting bracket wall mounting holes 28 and 29. In the embodiment shown, the mechanical fasteners 50 and 51 are threaded screws, however, any other suitable type of mechanical fasteners may be used, e.g., bolts or any other conventional type of mechanical fastener. In accordance with certain embodiments of the present invention, the mechanical fasteners may be self-tapping screws to secure the alignment mounting bracket 20 into metal and/or wood window studs. In accordance with certain embodiments, the mechanical fasteners may be secured using optional wall anchors 52. However, as described above, when the mounting bracket 20 is positioned adjacent to the window frame, a window stud is likely to be provided at such a location and the use of the wall anchors 52 may not be necessary. As shown in FIGS. 1-3, the alignment mounting bracket 20 may be secured to the support arm 60 with mechanical fasteners 54 and 55 through the alignment mounting bracket 20 mounting holes 48 and 49, and the support arm 60 connection slot 63. In the embodiment shown, mechanical fasteners 50 is a threaded screw, however, any other suitable type of mechanical fastener may be used, e.g., a thumb screw, a bolt or any other conventional type of mechanical fastener.

As shown in FIG. 2, the window curtain rod assembly 10 includes a rod section locking device 90 to fix the axial position of the first rod section 14 with respect to the second rod section 16, a first bushing 92 and a second bushing 94. The first and second bushings 92 and 94 provide for smooth axial movement between the rod sections. In the embodiment shown, the rod section locking device 90 is coupled to the second rod section 16 that is positioned inside the first rod section 14. In certain embodiments, the locking device 90 may include an axially offset cam and an eccentric sleeve around the cam, such that when the second rod section is rotated with respect to the first rod section, the eccentric sleeve pushes against an internal surface of the first rod section, thereby locking the axial position of the first rod section with respect to the second rod section. The rod section locking device 90 can be similar to the locking mechanisms disclosed in U.S. Patent Application Publication No. US2012/0005823A1 published Jan. 12, 2012, U.S. Patent Application Publication No. US2013/0112639A1 published May 9, 2013, and U.S. Pat. No. 8,814,114 issued Aug. 26, 2014, which are incorporated herein by reference. Other types of rod section locking devices may be used, such as those disclosed in U.S. Pat. No. 8,851,305 issued Oct. 7, 2014, and U.S. Pat. No. 8,960,456 issued Feb. 24, 2015, which are incorporated herein by reference. In another embodiment of the present invention, the rod section locking device 90 may include at least one mechanical fastener to fix the relative position of the rod sections. Any suitable number and arrangement of rod section locking devices 90 may be used, e.g., locking devices may be provided between each rod section of the telescoping curtain rod, or there may be no rod section locking devices in the telescoping curtain rod.

In accordance with certain embodiments of the present invention, the first rod section 14 and the second rod section 16 may be axially moveable and lockable with respect to each other, while the second rod section 16 and the third rod section 18 may be freely slideable with respect to each other. However, any other suitable arrangement of locking relationship may be used, e.g., the second rod section 16 and the third rod section 18 may be axially moveable and lockable with respect to each other, and/or the first rod section 14 and the second rod section 16 may be freely axially moveable with respect to each other. Any number of rod sections may be axially moveable and lockable with respect to each other, or any number of rod sections may be axially moveable, but not lockable with respect to each other.

FIGS. 1-3 illustrate a second alignment bracket assembly 119 of the window curtain rod assembly 10 in accordance with an embodiment of the present invention. Similar element numbers are used in FIGS. 1-3 for common features that are present in the first alignment bracket assembly 19 of FIGS. 1-12. As shown in FIGS. 1-3, the alignment bracket assembly 119 includes an alignment mounting bracket 120 and a support arm 160. The alignment mounting bracket 120 may be a mirror image of the alignment mounting bracket 20 as described in the first alignment bracket assembly 19 as shown in FIGS. 1-7. The support arm 160 may be a mirror image of the support arm 60 as described in the first alignment bracket assembly 19 as shown in FIGS. 1-3 and 8-11 with a first substantially cylindrical end 164 sized to receive the end 84 of the third rod section 18.

As shown in FIGS. 1-3, the alignment mounting bracket 120 includes a vertical guide leg 124, a first horizontal leg 130 and a second horizontal leg 140. The vertical guide leg 122 includes a vertical guide edge 124, a lower end 126 and an upper end terminating at a horizontal guide edge 132. In accordance with an embodiment of the present invention, the vertical guide leg 122 may also include alignment mounting bracket wall mounting holes (not shown). The first horizontal leg 130 may extend from the vertical guide leg 122 in a direction substantially parallel with the axial direction of telescoping curtain rod 12, and includes a horizontal guide edge 132 and a window frame end terminating in the vertical guide edge 124. The second horizontal leg 140 extends from the first horizontal leg extending in a direction substantially perpendicular to the axial direction of the telescoping curtain rod 12, and includes an upper edge 142 and a room end 144. The second horizontal leg 140 may also include support arm mounting holes (not shown). The first and second horizontal legs 130 and 140 intersect to form an alignment intersection 146. In accordance with certain embodiments of the present invention, the horizontal guide edge 132 of the first horizontal leg 130 may be substantially aligned with the upper edge 142 of the second horizontal leg 140. The alignment mounting bracket 120 of the second alignment bracket assembly 119 may be of the same or similar construction as the alignment mounting bracket 20 as described in the first alignment bracket assembly 19 as shown in FIGS. 1-17.

As shown in FIGS. 1-3, a support arm 160 may be attached to the alignment mounting bracket 120 of the alignment bracket assembly 119. The support arm 160 includes a first substantially cylindrical end 164 and a second end 161. The first substantially cylindrical end 164 defines an axis substantially aligned with an axial direction of the telescoping curtain rod 12. The second end 162 may be laterally offset from the first substantially cylindrical end 164 in a direction substantially perpendicular to the axis of the telescoping curtain rod 12 and/or the axis of the first substantially cylindrical end 164. The first substantially cylindrical end 164 may include a rod abutment face 166, a rod receiving opening 167 having an inner diameter selected based upon the outer diameter of the rod section that it receives, and a finial abutment face 169. The rod abutment face 66 may include a threaded finial hole 168. In accordance with an embodiment of the present invention, a mounting section 162 may be provided between the first substantially cylindrical end 164 and the second end 161. The mounting section 162 of the support arm 160 may include a connection slot 163 configured to allow the alignment mounting bracket 120 to be slideably mounted on the second end 61 of the support. The first substantially cylindrical end 64 may include an optional threaded thumb screw hole (not shown). The support arm 160 of the second alignment bracket assembly may be of the same or similar construction as the alignment mounting bracket 60 as described in the first alignment bracket assembly 19.

As shown in FIGS. 1-3, the alignment bracket assembly 119 has a vertical length, a curtain extension distance and a curtain overhang distance selected to properly position the window curtain rod assembly 10 during installation around a window frame 2. When the alignment mounting bracket 120 is positioned adjacent to the exterior window frame sidewall 4 or vertical portion of a window frame 2, the curtain extension distance of the alignment bracket assembly 119 provides for the telescoping curtain rod 12 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 10 provides the light-blocking and aesthetic function, and provides the ability for the alignment bracket assembly 119 to be mounted on the window stud without measuring. The vertical length, a curtain extension distance and a curtain overhang distance of the alignment bracket assembly 119 may be the same or similar to the vertical length H, the curtain extension distance L and the curtain overhang distance D of the alignment bracket assembly 19.

As shown in FIGS. 1-3, a finial 170 may also be attached to the alignment bracket assembly 119. The finial 170 includes a collar 172, a bracket engaging face 174 and a threaded bolt 176. The finial 170 of the second alignment bracket assembly 119 may be of the same or similar construction as the finial 70 as described in the first alignment bracket assembly 19.

In accordance with an embodiment of the present invention, the end 84 of the third rod section 18 may include a sleeve 86 with a threaded hole 87. The end 84 of the third rod section 18 may engage the second alignment bracket assembly 119 and the finial 170 using the same or similar engagement arrangements as described between the end 80 of the first rod section 14 and the first alignment bracket assembly 19 and the finial 70.

As shown in FIGS. 1-3, the alignment mounting bracket 120 may be secured to the wall with mechanical fasteners 150 and 151 through alignment mounting bracket wall mounting holes (not shown). In accordance with certain embodiments, the mechanical fasteners may be secured using optional wall anchors 152. As shown in FIGS. 1-3, the alignment mounting bracket 120 may be secured to the support arm 160 with mechanical fasteners 154 and 155 through the support arm mounting holes (not shown) and the alignment mounting bracket connection slot 163. The mechanical fasteners 150, 151, 154 and 155 of the second alignment bracket assembly may be of the same or similar construction as the mechanical fasteners 50, 51, 54 and 55 as described in the first alignment bracket assembly 19.

In accordance with certain embodiments of the present invention, the end 80 of the first rod section 14 and the end 84 of the third rod section 18 may be secured in the support arms 60 and 160 to prevent axial movement, and the rod section locking device 90 may fix the axial position of the intermediate rod section 16 with respect to the first rod section 14. For example, the end 80 of the first rod section 14 and the end 84 of the third rod section 18 may be inserted and secured in their corresponding first substantially cylindrical ends 64 and 164 by a threading engagement with the threaded bolts 76 and 176 of the finials 170 and 174. The intermediate or second rod section 16 between the first rod section 14 and the third rod section 18 has its axial movement in relation to the first rod section 14 fixed by the rod section locking device 90. This arrangement prevents the rod sections 14, 16 and 18 from axially moving in relation to each other when a curtain is pulled across the telescoping curtain rod 12. This represents an advantage over freely slideable telescoping rods that may move with a curtain when it is pulled axially across the telescoping curtain. The telescoping rod 12 having three sections also provides for the ability for the window curtain rod assembly 10 to cover a large range of window opening/frame widths. For example, a relatively short telescoping rod 12 may expand from 18 inches to 4 feet, and a relatively long telescoping rod may expand from 4 feet to 10 feet, thereby providing coverage for almost any standard-sized window by selecting either the shorter or longer version of the telescoping rod 12.

In accordance with an embodiment of the present invention, to install the window curtain rod assembly 10, the alignment mounting bracket 20 of the first alignment bracket assembly 19 may be positioned along a first vertical portion of a window frame 2 and mounted, e.g., on an underlying window stud. The alignment mounting bracket 120 of the second alignment bracket assembly 119 may be positioned along an opposite vertical portion of a window frame 2 and mounted on an opposite window stud. The end 80 of the first rod section 14 may be inserted into the first substantially cylindrical end 64 of the support arm 60 of the first alignment bracket assembly 19. The threaded bolt 76 of the finial 70 may be inserted through the finial hole 68 of the rod abutment face 66 and engaged with the threaded hole 83 of the threaded sleeve 82 at the end 80 of the first rod section 14. The end 84 of the third rod section 18 may be inserted into the first substantially cylindrical end 164 of the support arm 160 of the second bracket assembly 119. The first rod section 14 may then be axially locked with respect to the second rod section 16. The threaded bolt 176 of the finial 170 may be inserted through the finial hole 168 of the rod abutment face 166 and engaged with the threaded hole 87 of the threaded sleeve 86 at the end 84 of the third rod section 18.

FIGS. 12-19 illustrate a window curtain rod assembly 210 mounted over a window frame 202 in accordance with another embodiment of the present invention. In this embodiment, similar element numbers are used to describe similar features found in the previous embodiments. The window curtain rod assembly 210 includes a telescoping curtain rod 212, a first alignment bracket assembly 219 and a second alignment bracket assembly 319. As shown in FIGS. 12-15, the telescoping curtain rod 212 comprises a first telescoping rod section 214 (also called a first end rod section), a second telescoping rod section 216 (also called an intermediate rod section) and a third telescoping rod section 218 (also called a second end rod section). The first, second and third rod sections of this embodiment may be of the same or similar construction as the first, second and third rod sections as described in the previous embodiments.

The window curtain tension rod assembly 210 includes a rod section locking device (not shown), first bushing (not shown) and second bushing 294. The rod section locking device and first and second bushings of the present embodiment may be of the same or similar construction as the rod section device 90 as described in the previous embodiments as shown in FIGS. 1-11.

Figure 14:
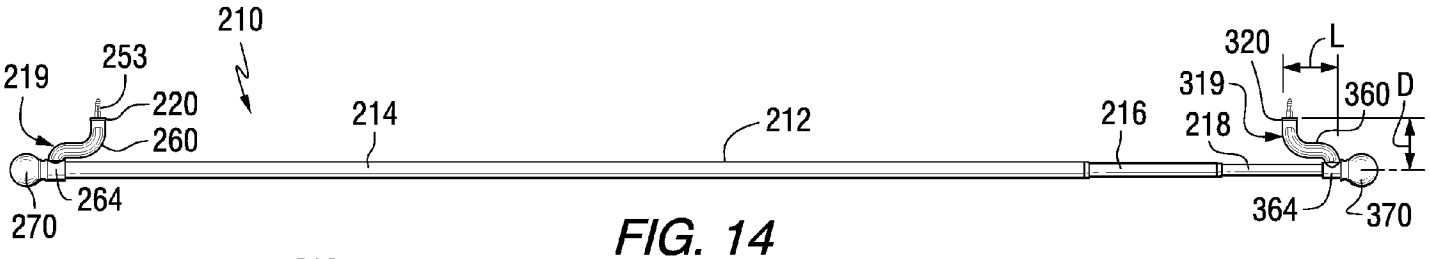
FIG. 14 is a top view of the window curtain rod assembly of FIG. 12.
Figure 15:
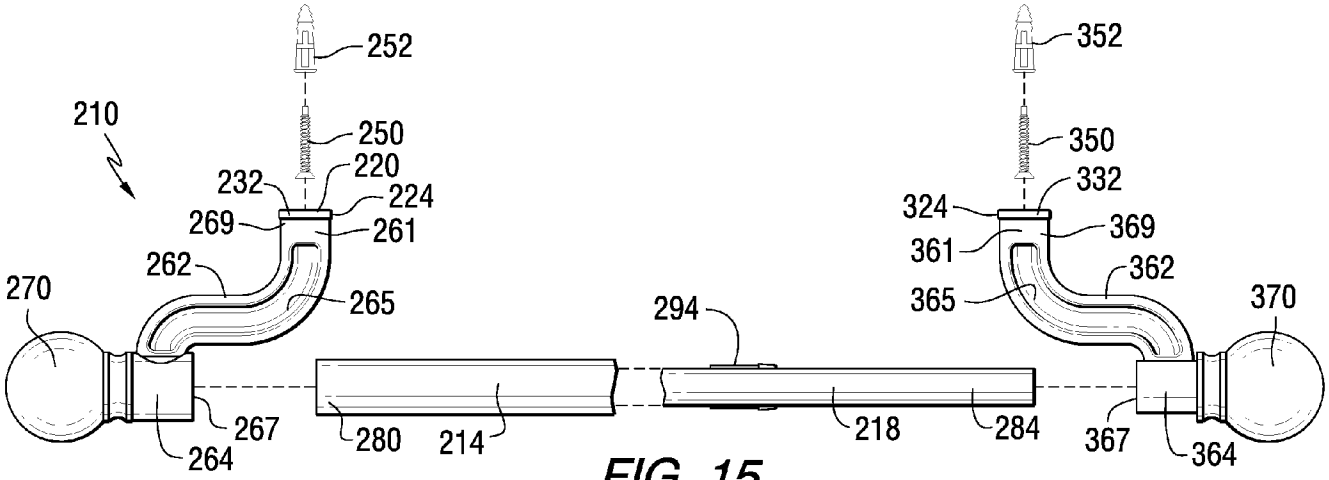
FIG. 15 is a top exploded view of the bracket assemblies of the window curtain rod assembly of FIG. 14.
Figure 16:
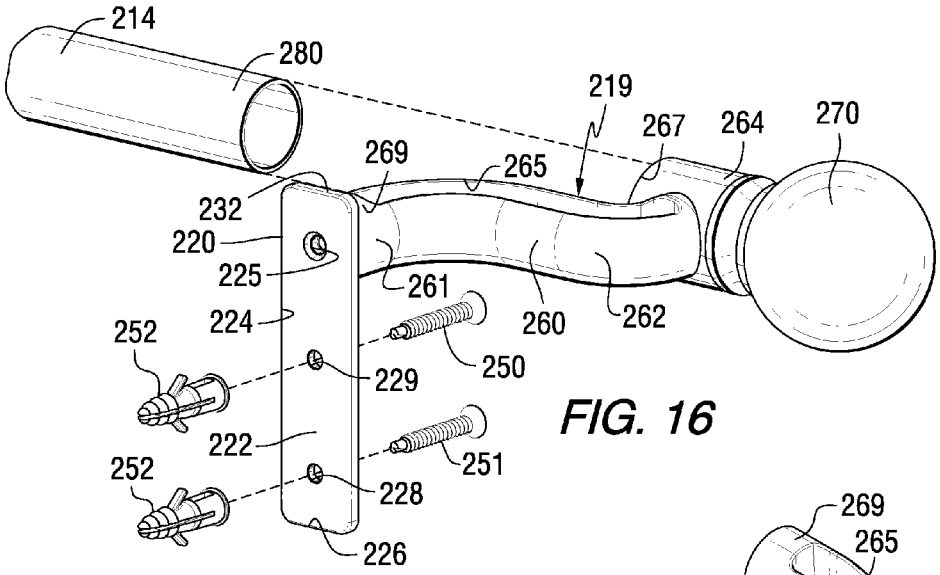
FIG. 16 is an isometric exploded view of an alignment bracket assembly in accordance with an embodiment of the present invention.

As shown in FIGS. 12-16, the first alignment bracket assembly 219 includes an alignment mounting bracket 220 and a support arm 260. The alignment mounting bracket 220 includes a vertical guide leg 222. In accordance with an embodiment of the present invention, the vertical guide leg 222 may include a vertical guide edge 224, a lower end 226 and an upper end terminating at a horizontal guide edge 232. As shown in FIG. 16, the vertical guide leg 222 may also include alignment mounting bracket wall mounting holes 228 and 229 and support arm mounting hole 225.

Figure 13:
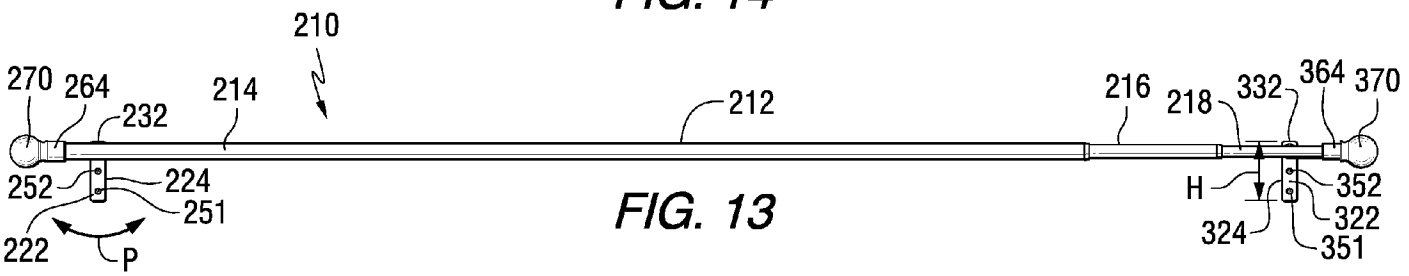
FIG. 13 is a front view of the window curtain rod assembly of FIG. 12.

As shown in FIGS. 13 and 14, the first alignment bracket assembly 219 has a vertical length H, a curtain extension distance L and a curtain overhang distance D selected to properly position the window curtain rod assembly 210 during installation around a window frame 2. The curtain extension distance L may be selected to allow the telescoping rod 212 and curtain to extend away from the exterior window frame sidewall 204 of the window frame 202 in a direction parallel with the axial direction of the telescoping curtain rod 212. The curtain extension distance L offsets the vertical guide edge 224 from the end 280 of the first rod section 214 and/or the rod abutment face 266 of the support arm 260 in a direction parallel with the axis of the telescoping curtain rod 212. For example, the curtain extension distance L of the first alignment bracket assembly 219 may typically range from 1 to 8 inches, or from 1.5 to 6 inches, or from 2 to 5 inches. The vertical length H of the first alignment bracket assembly 219 may also be selected to properly position the window curtain rod assembly 210 during installation around a window frame 202. The vertical length H may be selected to provide the vertical guide edge 224, and access to the alignment mounting bracket wall mounting holes 228 and 229 and support arm mounting hole 225. For example, vertical length H may typically range from 1 to 6 inches, or from 1.5 to 5.5 inches, or from 2 to 4 inches. The curtain overhang distance D of the first alignment bracket assembly 219 may also be selected to properly position the telescoping rod 12 away from the wall when installed. The curtain overhang distance D offsets the vertical guide leg 222 from the axis of the telescoping curtain rod 212 in a direction perpendicular to the axis of the telescoping curtain rod. For example, the room depth D may typically range from 0.5 to 6 inches, or from 1 to 5 inches, or from 1.5 to 4 inches.

Figure 12:
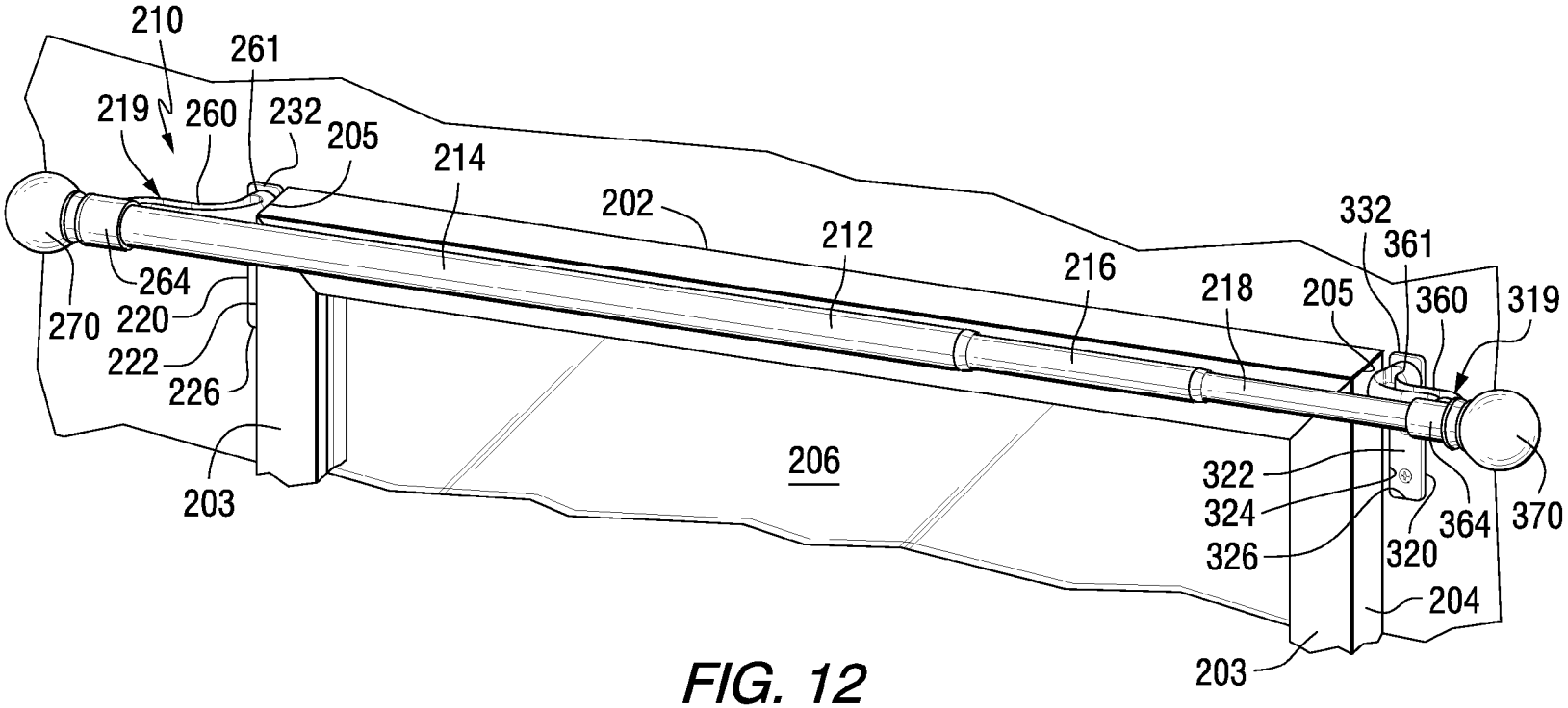
FIG. 12 is an isometric view of the window curtain rod assembly in accordance with another embodiment of the present invention, illustrating the window curtain rod assembly mounted around a window frame.

As shown in FIG. 12, the vertical guide edge 224 of the alignment mounting bracket 220 may be positioned to align with the exterior window frame sidewall 204 of the window frame 202. In accordance with an embodiment of the present invention, the vertical guide edge 24 may be positioned directly adjacent to the exterior window frame sidewall 204 of the window frame 202. When the vertical guide edge 224 is positioned to align with the exterior window frame sidewall 4 of a window frame 202, this arrangement may provide for the alignment mounting bracket to be mounted on the window stud. The curtain extension distance L provides the ability for the curtain to extend beyond the window frame while mounting the alignment mounting bracket on the window stud adjacent to the exterior window frame sidewall of a window frame. In another embodiment, the vertical guide edge may be positioned directly above the exterior window frame sidewall or vertical portion of a window frame 2. As shown in FIG. 12, the horizontal guide edge 232 of the mounting alignment bracket 220 may be positioned to align with the top edge 205 of the window frame 202. In another embodiment, a user may desire to position the window curtain rod assembly higher than the top edge 205 of the window frame. Such positioning may be performed by aligning the vertical guide edge 224 with the exterior window frame sidewall 4 or vertical portion of a window frame 2. The use of the vertical guide edge 24 and/or the horizontal guide edge 232 in accordance with an embodiment of the present invention provides for installation of the window curtain rod assembly 210 without the need to measure.

As shown in FIGS. 12-19, the support arm 260 includes a first substantially cylindrical end 264 and a second end 261. The first substantially cylindrical end 264 defines an axis substantially aligned with the axis of the telescoping curtain rod 212. The second end 261 may be laterally offset from the first substantially cylindrical end 264 in a direction parallel with the axis of the telescoping curtain rod 212, and also in a direction perpendicular to the axis of the telescoping curtain rod 212. The first substantially cylindrical end 264 includes a rod receiving opening 267 having a cylindrical inner surface with an inner diameter selected based upon the outer diameter of the rod section that it receives and a rod abutment face 266. In accordance with certain embodiments, the first substantially cylindrical end 264 may also include a decorative finial 270. The second end 261 of the support arm 260 includes a threaded alignment mounting bracket hole 263. The hole 263 is used to rotatably mount the mounting alignment bracket 220 onto the support arm 260, as more fully described below. In another embodiment, the alignment mounting bracket hole 263 may not be threaded.

As shown in FIGS. 12, 14, 15-17 and 18, in accordance with an embodiment of the present invention, the support arm 260 may have a generally "S"-shaped section 262 extending from the first substantially cylindrical end 264 to the second end 261. The generally S-shaped section 262 includes an upper edge 269. In accordance with an embodiment of the present invention, the upper edge 269 may be substantially aligned with the horizontal guide edge of the horizontal guide edge 232 of the alignment mounting bracket 220. The S-shaped section 262 may comprise an upwardly open recess 265. The recess 265 may be provided on the S-shaped section 262 in order to eliminate unnecessary material. In the embodiment shown, the S-shaped section 262 includes a single recess 265 encompassing the entire S-shaped section 262. However, any other suitable shape and arrangement of recesses may be used, e.g., the S-shaped section 262 may have a plurality of recesses, and/or the recess may encompass a portion of the S-shaped section.

Figure 19:
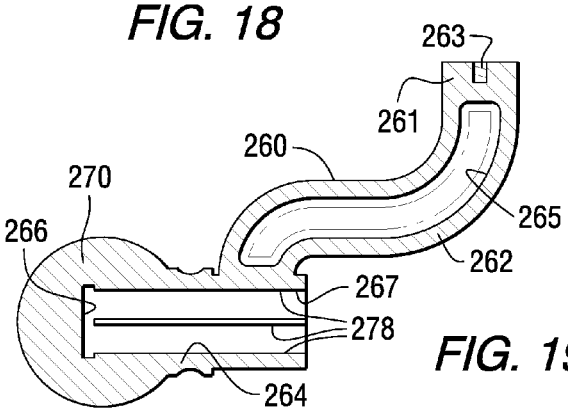
FIG. 19 is a partially schematic top cross sectional view of FIG. 18.

As shown in FIG. 13, the alignment mounting bracket 220 and the support arm 260 may be moveably mounted. In accordance with an embodiment of the present invention, the alignment mounting bracket 220 may pivotably P attached to the second end 261 of the support arm 260. As shown in FIGS. 16 and 19, the alignment mounting bracket 220 may be rotatably attached to the second end 261 of the support arm 260 by inserting a mechanical fastener through support arm mounting hole 225 into threaded alignment mounting bracket hole 263. This arrangement allows the mounting bracket 220 to rotate in relation to the support arm 260 in order to facilitate adjustments when installing on non-uniform window frames, and to allow the mounting bracket to rotate 90° when packaged to reduce its packaging depth requirements. In accordance with certain embodiments of the present invention, the support arm mounting hole 225 may be countersunk so that the mechanical fastener can be inserted flush with the surface of the alignment mounting bracket 220. Alternatively, the alignment mounting bracket 220 and the support arm 260 may be fixed in relation to each other or integrally formed.

Figure 18:
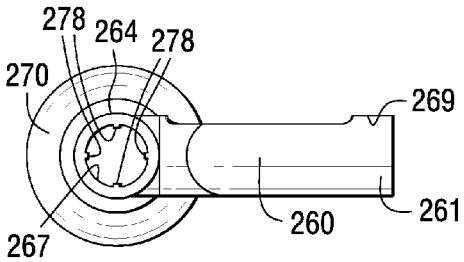
FIG. 18 is a partially schematic side view of the support arm of FIG. 17.
Figure 17:
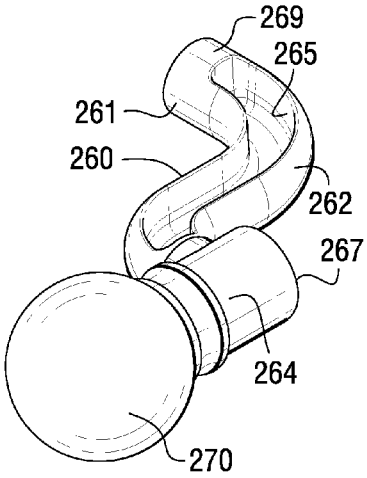
FIG. 17 is an isometric view of a support arm of an alignment bracket assembly in accordance with an embodiment of the present invention.

As shown in FIGS. 18 and 19, the first substantially cylindrical end 264 of the support arm 260 of the first alignment bracket assembly 219 comprises at least one radially inwardly extending friction rib 278 running substantially parallel with the axial direction of the telescoping curtain rod 212. In the embodiment shown, there are four friction ribs 278, but any other suitable number of friction ribs may be used. For example, there may be zero, one, two, three, four or more friction ribs. In accordance with embodiments of the present invention, the friction ribs 278 are provided in order to provide controlled frictional engagement between the end 280 the first rod section 214 and the first substantially cylindrical end 264 once the rod is inserted. In accordance with an embodiment of the present invention, the end 280 of the first rod section 214 is frictionally held in the first substantially cylindrical end 264 of the support rod 260 by contact between at least a portion of an outer diameter the first rod section 214 with either an inner diameter of the first substantially cylindrical end 264 or at least one radially inwardly projecting rib 248, as shown in FIGS. 18 and 19, extending from the inner diameter of the first substantially cylindrical end. However, any other suitable shape and arrangement of engagement between the end 80 of the first rod section 214 and the first substantially cylindrical end 264 may be used, e.g., pins, mechanical fasteners, clamps, snap-fit, adhesives, or the like. In accordance with an embodiment of the present invention, when the end 80 of the first rod section 214 is inserted into the first substantially cylindrical end 264 of the support arm 260, the end 280 contacts the rod abutment face 266.

As shown in FIGS. 15 and 16, the alignment mounting bracket 220 may be secured to the wall with mechanical fasteners 250 and 251 through alignment mounting bracket wall mounting holes 228 and 229. In the embodiment shown, the mechanical fasteners 250 and 251 are threaded screws, however, any other suitable type of mechanical fasteners may be used, e.g., bolts or any other conventional type of mechanical fastener. In accordance with certain embodiments of the present invention, the mechanical fasteners may be self-tapping screws to secure the alignment mounting bracket 220 into metal and/or wood window studs. In accordance with certain embodiments, the mechanical fasteners may be secured using optional wall anchors 252.

FIGS. 12-15 illustrate a second alignment bracket assembly 319 of the window curtain rod assembly 210 in accordance with an embodiment of the present invention. Similar element numbers are used in FIGS. 12-15 for common features that are present in the first alignment bracket assembly 219 of FIGS. 12-16. As shown in FIGS. 12-15, the alignment bracket assembly 319 includes an alignment mounting bracket 320 and a support arm 360. The alignment mounting bracket 320 may be a mirror image of the alignment mounting bracket 220 as described in the first alignment bracket assembly 219 as shown in FIGS. 12-16. The support arm 360 may be a mirror image of the support arm 260 as described in the first alignment bracket assembly 219 as shown in FIGS. 12-19 with a first substantially cylindrical end 364 sized to receive the end 284 the third rod section 218.

As shown in FIGS. 12-15, the alignment mounting bracket 320 includes a vertical guide leg 322. In accordance with an embodiment of the present invention, the vertical guide leg 322 may include a vertical guide edge 324, a lower end 326 and an upper end terminating at a horizontal guide edge 332. In accordance with an embodiment of the present invention, the vertical guide leg 322 may also include alignment mounting bracket wall mounting holes (not shown) and support arm mounting hole (not shown). The alignment mounting bracket 320 of the second alignment bracket assembly 319 may be of the same or similar construction as the alignment mounting bracket 220 as described in the first alignment bracket assembly 219 as shown in FIGS. 12-16.

As shown in FIGS. 12-15, the support arm 360 may be attached to the alignment mounting bracket 320 of the alignment bracket assembly 319. The support arm 360 includes a first substantially cylindrical end 364 and a second end 361. The first substantially cylindrical end 264 defines an axis substantially aligned with the axis of the telescoping curtain rod 212. The second end 361 may be laterally offset from the first substantially cylindrical end 364 in a direction substantially parallel with the axis of the telescoping curtain rod 212, and also in perpendicular to the axis of the telescoping curtain rod 212. The first substantially cylindrical end 364 includes a rod receiving opening 367 having cylindrical inner surface with an inner diameter selected based upon the outer diameter of the rod section that it receives and a rod abutment face 366. In accordance with certain embodiments, the first substantially cylindrical end 364 may also include a decorative finial 370. The second end 361 of the support arm 360 includes an optionally threaded alignment mounting bracket hole (not shown). The alignment mounting bracket 220 may be secured to the wall with mechanical fasteners 350 and 351 through alignment mounting bracket wall mounting holes. The support arm 360 of the second alignment bracket assembly 319 may be of the same or similar construction as the support arm 360 as described in the first alignment bracket assembly 219 as shown in FIGS. 12-16.

As shown in FIGS. 12-15, the alignment bracket assembly 319 has a vertical length, a curtain extension distance and a curtain overhang distance selected to properly position the window curtain rod assembly 210 during installation around a window frame 202. When the alignment mounting bracket 320 is positioned adjacent to the exterior window frame sidewall 204 or vertical portion of a window frame 202, the curtain extension distance of the alignment bracket assembly 319 provides for the telescoping curtain rod 212 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 210 provides the light-blocking and aesthetic function, and provides the ability for the alignment bracket assembly 319 to be mounted on the window stud without measuring. The vertical length, a curtain extension distance and a curtain overhang distance of the alignment bracket assembly 319 may be the same or similar to the vertical length H, a curtain extension distance L and a curtain overhang distance D of the alignment bracket assembly 219.

As shown in FIGS. 12, 14 and 15, in accordance with an embodiment of the present invention, the support arm 360 may have a generally "S"-shaped section 362 extending from the first substantially cylindrical end 364 to the second end 361. The generally S-shaped section 362 may include an upper edge 369. In accordance with an embodiment of the present invention, the upper edge 369 may be substantially aligned with the horizontal guide edge of the horizontal guide edge 332 of the alignment mounting bracket 320. The S-shaped section 362 may comprise an upwardly open recess 365. The support arm 360 of the second alignment bracket assembly 319 may be of the same or similar construction as the support arm 360 as described in the first alignment bracket assembly 219 as shown in FIGS. 12-16.

The alignment mounting bracket 320 and the support arm 360 may be moveable mounted. The mounting between the alignment mounting bracket 320 and the support arm 360 may performed with the same or similar arrangements as the alignment mounting bracket 220 and the support arm 260 as described in the first alignment bracket assembly 219 as shown in FIGS. 12-16.

In accordance with an embodiment of the present invention, the end 284 of the third rod section 218 may be engaged with the first substantially cylindrical end 364 of the support arm 360 using the same or similar engagement arrangements as described between the end 280 of the first rod section 214 and the first substantially cylindrical end 264 of the support arm 260.

In accordance with an embodiment of the present invention, to install the window curtain rod assembly 210, the alignment mounting bracket 220 of the first alignment bracket assembly 219 may be positioned along a first vertical portion of a window frame 202 and mounted, e.g., on an underlying window stud. The alignment mounting bracket 320 of the second alignment bracket assembly 319 may be positioned along an opposite vertical portion of a window frame 202 and mounted on an opposite window stud. The end 280 of the first rod section 214 may be inserted into the first substantially cylindrical end 264 of the support arm 260 of the first alignment bracket assembly 219. The end 284 of the third rod section 218 may be inserted into the first substantially cylindrical end 364 of the support arm 360 of the second bracket assembly 319. The first rod section 214 may then be axially locked with respect to the second rod section 216.

The telescoping curtain rods, alignment mounting brackets, support arms, finials and fasteners may be made from any suitable materials such as plastics, metals and the like. For example, the telescoping curtain rods and the mounting alignment brackets may be made of metal such as aluminum and/or steel. The support arms and finials may be made of metals or polymeric materials such as polyethylene, polypropylene, nylon, and the like.

Whereas particular embodiments of this invention have been described above for purposes of illustration, it will be evident to those skilled in the art that numerous variations of the details of the present invention may be made without departing from the invention as defined in the appended claims.

What is claimed is:

1. A window curtain rod assembly comprising:

a telescoping curtain rod comprising a first end rod section and a second end rod section axially moveable with respect to each other along an axis of the telescoping curtain rod;

a first alignment bracket assembly comprising:

a first support arm including a first substantially cylindrical end receiving an end of the first end rod section and having an axis substantially aligned with the axis of telescoping curtain rod, and a second end laterally offset from the first substantially cylindrical end in a direction substantially perpendicular to the axis of the telescoping curtain rod; and a first alignment mounting bracket attached to the second end of the first support arm including a vertical guide leg laterally offset from the axis of the telescoping curtain rod by a first curtain overhang distance measured in a direction perpendicular to the axis of the telescoping curtain rod, the vertical guide leg comprising a vertical guide edge laterally offset from the end of the first end rod section by a first curtain extension distance measured in a direction parallel with the axis of the telescoping curtain rod; and a second alignment bracket assembly comprising:

a second support arm including a first substantially cylindrical end receiving an end of the second end rod section and having an axis substantially aligned with the axis of the telescoping curtain rod, and a second end laterally offset from the first substantially cylindrical end in a direction substantially perpendicular to the axis of the telescoping curtain rod; and a second alignment mounting bracket attached to the second end of the second support arm including a vertical guide leg laterally offset from the axis of the telescoping curtain rod by a second curtain overhang distance measured in a direction perpendicular to the axis of the telescoping curtain rod, the vertical guide leg comprising a vertical guide edge laterally offset from the end of the first end rod section by a second curtain extension distance measured in a direction parallel with the axis of the telescoping curtain rod, wherein the first substantially cylindrical end of the first support arm comprises a first rod abutment face contacting the end of the first end rod section, and the second substantially cylindrical end of the second support arm comprises a second rod abutment face contacting the end of the second end rod section.

2. The window curtain rod assembly of claim 1, wherein the first and second curtain extension distances are from 2 to 6 inches.

3. The window curtain rod assembly of claim 1, wherein the first and second curtain overhang distances are from 1 to 6 inches.

4. The window curtain rod assembly of claim 1, wherein the vertical guide edge of the first alignment mounting bracket is substantially straight and has a length measured in a vertical direction of from 1 to 6 inches, and the vertical guide edge of the second alignment mounting bracket is substantially straight and has a length H measured in a vertical direction of from 1 to 6 inches.

5. The window curtain rod assembly of claim 1, wherein the vertical guide leg of the first alignment mounting bracket further comprises a substantially straight horizontal guide edge, and the vertical guide leg of the second alignment mounting bracket further comprises a substantially straight horizontal guide edge.

6. The window curtain rod assembly of claim 1, wherein the first alignment mounting bracket is moveably mounted on the second end of the first support arm, and the second alignment mounting bracket is moveably mounted on the second end of the second support arm.

7. The window curtain rod assembly of claim 6, wherein the first alignment mounting bracket is slideably mounted on the second end of the first support arm for movement in an extension direction perpendicular to the axis of the telescoping curtain rod, and the second alignment mounting bracket is slideably mounted on the second end of the second support arm for movement in an extension direction perpendicular to the axis of the telescoping curtain rod.

8. The window curtain rod assembly of claim 1, wherein the first alignment mounting bracket further comprises a first horizontal leg extending from the vertical guide leg in a direction substantially parallel with the axis of the telescoping rod and a second horizontal leg extending from the first horizontal leg in a direction substantially perpendicular to the axis of the telescoping rod, and the second alignment mounting bracket further comprises a first horizontal leg extending from the vertical guide leg in a direction substantially parallel with the axis of the telescoping rod and a second horizontal leg extending from the first horizontal leg in a direction substantially perpendicular to the axis of the telescoping rod.

9. The window curtain rod assembly of claim 8, wherein the second horizontal leg of the first alignment mounting bracket is slideably mounted on the second end of the first support arm, and the second horizontal leg of the second alignment mounting bracket is slideably mounted on the second end of the second support arm.

10. The window rod assembly of claim 1, further comprising a first finial including a threaded bolt extending into the first substantially cylindrical end of the first support arm and engaging a threaded hole of the end of the first end rod section, and a second finial including a threaded bolt extending into the first substantially cylindrical end of the second support arm and engaging a threaded hole of the end of the second end rod section.

11. The window rod assembly of claim 10, wherein the first substantially cylindrical end of the first support arm comprises a first rod abutment face with a hole extending therethough aligned with the axis of the telescoping curtain rod, the threaded bolt of the first finial is inserted through the rod abutment face hole of the first rod abutment face, the first substantially cylindrical end of the second support arm comprises a second rod abutment face with a hole extending therethough aligned with the axis of the telescoping curtain rod, and the threaded bolt of the first finial is inserted through the rod abutment face hole of the second rod abutment face.

12. The window rod assembly of claim 11, wherein the rod abutment face hole of the first rod abutment face is threadingly engaged with the threaded bolt of the first finial, and the rod abutment face hole of the second rod abutment face is threadingly engaged with the threaded bolt of the second finial.

13. The window rod assembly of claim 10, wherein the first substantially cylindrical end of the first support arm comprises a first finial abutment face contacting a bracket engaging face of the first finial, and the first substantially cylindrical end of the second support arm comprises a second finial abutment face contacting a bracket engaging face of the second finial.

14. The window rod assembly of claim 1, wherein the first end rod section and the second end rod section are lockable with respect to each other.

15. The window curtain rod assembly of claim 14, further comprising an intermediate rod section between the first end rod section and the second end rod section, and lockable to at least one of the first end rod section and the second end rod section.

16. The window curtain rod assembly of claim 15, wherein the intermediate rod section is axially moveable and lockable with respect to the first end rod section, and the intermediate rod section is axially moveable and freely slideable with respect to the second end rod section.

17. A method of mounting the window curtain rod assembly of claim 1 adjacent to a window, the method comprising:

positioning the vertical guide edge of first alignment bracket assembly along a first vertical portion of a window frame;

positioning the vertical guide edge of the second alignment bracket assembly along a second vertical portion of the window frame;

axially locking the first end rod section with respect to the second end rod section; and fastening the first and second alignment bracket assemblies at their respective positions with respect to the window frame.

18. A window curtain rod assembly comprising:

a telescoping curtain rod comprising a first end rod section and a second end rod section axially moveable with respect to each other along an axis of the telescoping curtain rod;

a first alignment bracket assembly comprising:

a first support arm including a first substantially cylindrical end receiving an end of the first end rod section and having an axis substantially aligned with the axis of telescoping curtain rod, and a second end laterally offset from the first substantially cylindrical end in a direction substantially perpendicular to the axis of the telescoping curtain rod; and a first alignment mounting bracket attached to the second end of the first support arm including a vertical guide leg laterally offset from the axis of the telescoping curtain rod by a first curtain overhang distance measured in a direction perpendicular to the axis of the telescoping curtain rod, the vertical guide leg comprising a vertical guide edge laterally offset from the end of the first end rod section by a first curtain extension distance measured in a direction parallel with the axis of the telescoping curtain rod; and a second alignment bracket assembly comprising:

a second support arm including a first substantially cylindrical end receiving an end of the second end rod section and having an axis substantially aligned with the axis of the telescoping curtain rod, and a second end laterally offset from the first substantially cylindrical end in a direction substantially perpendicular to the axis of the telescoping curtain rod; and a second alignment mounting bracket attached to the second end of the second support arm including a vertical guide leg laterally offset from the axis of the telescoping curtain rod by a second curtain overhang distance measured in a direction perpendicular to the axis of the telescoping curtain rod, the vertical guide leg comprising a vertical guide edge laterally offset from the end of the first end rod section by a second curtain extension distance measured in a direction parallel with the axis of the telescoping curtain rod, wherein the first alignment mounting bracket further comprises a first horizontal leg extending from the vertical guide leg in a direction substantially parallel with the axis of the telescoping rod and a second horizontal leg extending from the first horizontal leg in a direction substantially perpendicular to the axis of the telescoping rod, and the second alignment mounting bracket further comprises a first horizontal leg extending from the vertical guide leg in a direction substantially parallel with the axis of the telescoping rod and a second horizontal leg extending from the first horizontal leg in a direction substantially perpendicular to the axis of the telescoping rod.

19. The window curtain rod assembly of claim 18, wherein the second horizontal leg of the first alignment mounting bracket is slideably mounted on the second end of the first support arm, and the second horizontal leg of the second alignment mounting bracket is slideably mounted on the second end of the second support arm.

20. A window curtain rod assembly comprising:

a telescoping curtain rod comprising a first end rod section and a second end rod section axially moveable with respect to each other along an axis of the telescoping curtain rod;

a first alignment bracket assembly comprising:

a first support arm including a first substantially cylindrical end receiving an end of the first end rod section and having an axis substantially aligned with the axis of telescoping curtain rod, and a second end laterally offset from the first substantially cylindrical end in a direction substantially perpendicular to the axis of the telescoping curtain rod; and a first alignment mounting bracket attached to the second end of the first support arm including a vertical guide leg laterally offset from the axis of the telescoping curtain rod by a first curtain overhang distance measured in a direction perpendicular to the axis of the telescoping curtain rod, the vertical guide leg comprising a vertical guide edge laterally offset from the end of the first end rod section by a first curtain extension distance measured in a direction parallel with the axis of the telescoping curtain rod;

a second alignment bracket assembly comprising:

a second support arm including a first substantially cylindrical end receiving an end of the second end rod section and having an axis substantially aligned with the axis of the telescoping curtain rod, and a second end laterally offset from the first substantially cylindrical end in a direction substantially perpendicular to the axis of the telescoping curtain rod; and a second alignment mounting bracket attached to the second end of the second support arm including a vertical guide leg laterally offset from the axis of the telescoping curtain rod by a second curtain overhang distance measured in a direction perpendicular to the axis of the telescoping curtain rod, the vertical guide leg comprising a vertical guide edge laterally offset from the end of the first end rod section by a second curtain extension distance measured in a direction parallel with the axis of the telescoping curtain rod; and a first finial including a threaded bolt extending into the first substantially cylindrical end of the first support arm and engaging a threaded hole of the end of the first end rod section, and a second finial including a threaded bolt extending into the first substantially cylindrical end of the second support arm and engaging a threaded hole of the end of the second end rod section, wherein the first substantially cylindrical end of the first support arm comprises a first rod abutment face with a hole extending therethough aligned with the axis of the telescoping curtain rod, the threaded bolt of the first finial is inserted through the rod abutment face hole of the first rod abutment face, the first substantially cylindrical end of the second support arm comprises a second rod abutment face with a hole extending therethough aligned with the axis of the telescoping curtain rod, and the threaded bolt of the first finial is inserted through the rod abutment face hole of the second rod abutment face.

21. The window rod assembly of claim 20, wherein the rod abutment face hole of the first rod abutment face is threadingly engaged with the threaded bolt of the first finial, and the rod abutment face hole of the second rod abutment face is threadingly engaged with the threaded bolt of the second finial.

22. The window rod assembly of claim 20, wherein the first substantially cylindrical end of the first support arm comprises a first finial abutment face contacting a bracket engaging face of the first finial, and the first substantially cylindrical end of the second support arm comprises a second finial abutment face contacting a bracket engaging face of the second finial.

* * * * *